US011384525B2

(12) United States Patent
Jalla

(10) Patent No.: US 11,384,525 B2
(45) Date of Patent: Jul. 12, 2022

(54) CONSTRUCTION AND MONITORING OF BARRIER WALLS

(71) Applicant: Consulting Engineers, Corp., Reston, VA (US)

(72) Inventor: Maharaj K. Jalla, Great Falls, VA (US)

( * ) Notice: Subject to any disclaimer, the term of this patent is extended or adjusted under 35 U.S.C. 154(b) by 151 days.

(21) Appl. No.: 16/835,610

(22) Filed: Mar. 31, 2020

(65) Prior Publication Data

US 2020/0318337 A1 Oct. 8, 2020

Related U.S. Application Data

(60) Provisional application No. 62/827,874, filed on Apr. 2, 2019.

(51) Int. Cl.
*E04B 1/04* (2006.01)
*E02D 27/32* (2006.01)

(52) U.S. Cl.
CPC ..... *E04B 1/04* (2013.01); *E02D 27/32* (2013.01)

(58) Field of Classification Search
CPC .. E04B 1/04; E02D 27/32; E02D 5/30; E02D 5/20; E02D 5/18
See application file for complete search history.

(56) References Cited

U.S. PATENT DOCUMENTS 4,000,622 A * 1/1977 Chiaves ..... E02D 29/0266 405/286
4,290,246 A * 9/1981 Hilsey ..... E02D 27/02 52/125.3
4,668,129 A * 5/1987 Babcock ..... E02D 29/0266 405/284
4,728,227 A * 3/1988 Wilson ..... E02D 29/0241 405/262
5,433,049 A * 7/1995 Karlsson ..... E02D 31/02 52/293.2
5,468,098 A * 11/1995 Babcock ..... E02D 29/0225 405/262
5,471,811 A * 12/1995 House ..... E01F 8/0011 256/13.1
5,588,786 A * 12/1996 House ..... E01F 8/0011 405/284
8,713,871 B2 * 5/2014 Wallin ..... E02D 27/02 52/270
10,344,444 B2 * 7/2019 Durkin ..... E02D 29/0225
10,422,156 B1 * 9/2019 Morrow ..... E04H 17/168
10,633,887 B1 * 4/2020 Fisher ..... B66C 1/42
10,683,656 B1 * 6/2020 Van Doren ..... E04C 2/30
10,740,721 B1 * 8/2020 Jalla ..... G06F 30/10
10,889,977 B1 * 1/2021 Beck, III ..... E04H 17/16
(Continued)

*Primary Examiner* — Paola Agudelo
(74) *Attorney, Agent, or Firm* — Andrew Morabito

(57) ABSTRACT

The present invention is a barrier wall comprising: a foundation, wherein the foundation has a plurality of extensions protruding from one side of the foundation; a set of lower buttress walls positioned along each of the extensions; a first deck positioned on the first set of lower buttress walls; a set of upper buttress walls positioned along the decks upper surface; a second deck positions on the second set of upper buttress walls; and a front wall positioned to substantially cover the set of lower buttress walls, the lower deck, the set of upper buttress walls, and the upper deck.

13 Claims, 20 Drawing Sheets

(56) References Cited

U.S. PATENT DOCUMENTS

| | | | | |
|---|---|---|---|---|
| 2008/0226391 | A1* | 9/2008 | Phillips | E06B 11/045 404/6 |
| 2010/0059728 | A1* | 3/2010 | Bishop | E02B 3/06 256/24 |
| 2018/0283041 | A1* | 10/2018 | Markham | E01F 13/02 |
| 2019/0032339 | A1* | 1/2019 | Matturro | E04H 15/008 |

* cited by examiner

CONSTRUCTION AND MONITORING OF BARRIER WALLS

CROSS-REFERENCE TO RELATED APPLICATIONS

This application is a continuation-(and claims the benefit of priority under 35 USC 120) of U.S. application No. 62/827,874 filed Apr. 2, 2019. The disclosure of the prior applications is considered part of (and is incorporated by reference in) the disclosure of this application.

BACKGROUND OF THE INVENTION

The present invention relates to a building system, and more particularly to the building process of a wall for security purposes.

Border and/or security walls are critical for engineering design because of its Geometry and location. Example is the barrier wall along the United States and Mexico border which is a nationwide topic of discussion. However, the 2-Dimensional approach for the wall design increases the construction cost due to thicker wall sections by using traditional design approach.

Additionally, with the length of a barrier wall there is a variety of terrain, unlevel terrain, and various of geographical features which the wall has to be built through or around. This provides for a diverse number of issues if the wall design is not able to be built through uneven terrain or around various obstacles. Construction of the walls such as a barrier wall with concrete has the challenge due to the difficult terrain and the geometry of the structure.

Another issue is the length of ground which the wall is to cover may require constant maintenance after the wall is constructed, this would require a modular design to allow for work on specific sections of the wall without affecting the other portions of the wall. More specifically, the reconfigurable barrier system is a system having structural components which may be modularly assembled to quickly and conveniently erect a barrier structure that is highly secure and stable yet adaptable in configuration to the particular property being protected.

The wall also needs to provide minimal effect on the geographical and environmental landscape to allow for the ecosystem to be maintained and waterways to be unimpeded.

The present invention provides for a solution to these and additional issues which have risen with the discussion of barrier walls and protecting areas in general.

SUMMARY

The present invention provides for a barrier wall with a front wall extending upwardly which acts as a barrier between two regions. Buttress walls extending from the rear side of the front wall. The buttress walls provide for lateral support for the front wall. The plurality of Buttress walls are spaced specific distances and provides the 3-Dimensional approach for the load transfer. Horizontal decks positioned between the buttress wall layers. The horizontal decks are positioned at half or a third the height of the front wall. Additional horizontal decks are positioned three quarters or seven eighths of the total height of front wall. Horizontal deck provides the lateral stability by providing the diaphragm action for horizontal load transfer.

The present invention provides for additional features of a security system. The barrier wall is embedded with conduit for connection of the monitoring system. Monitoring feature of motion sensor probe is provided inside the footing of foundation. Wire for the motion sensor probe is passing through the conduits and connects with the recording device of the security system.

DETAILED DESCRIPTION OF THE INVENTION

Figure 1:
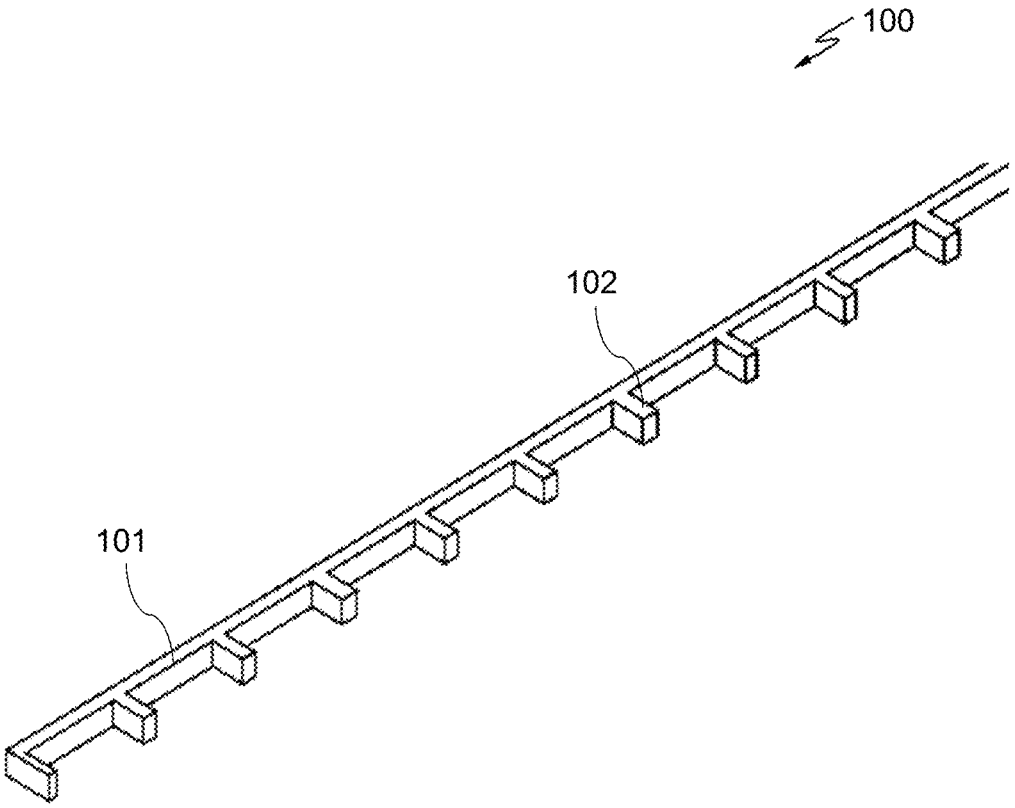
FIG. 1 is an isometric view of the foundation for barrier wall with buttress, in accordance with one embodiment of the present invention.
Figure 2:
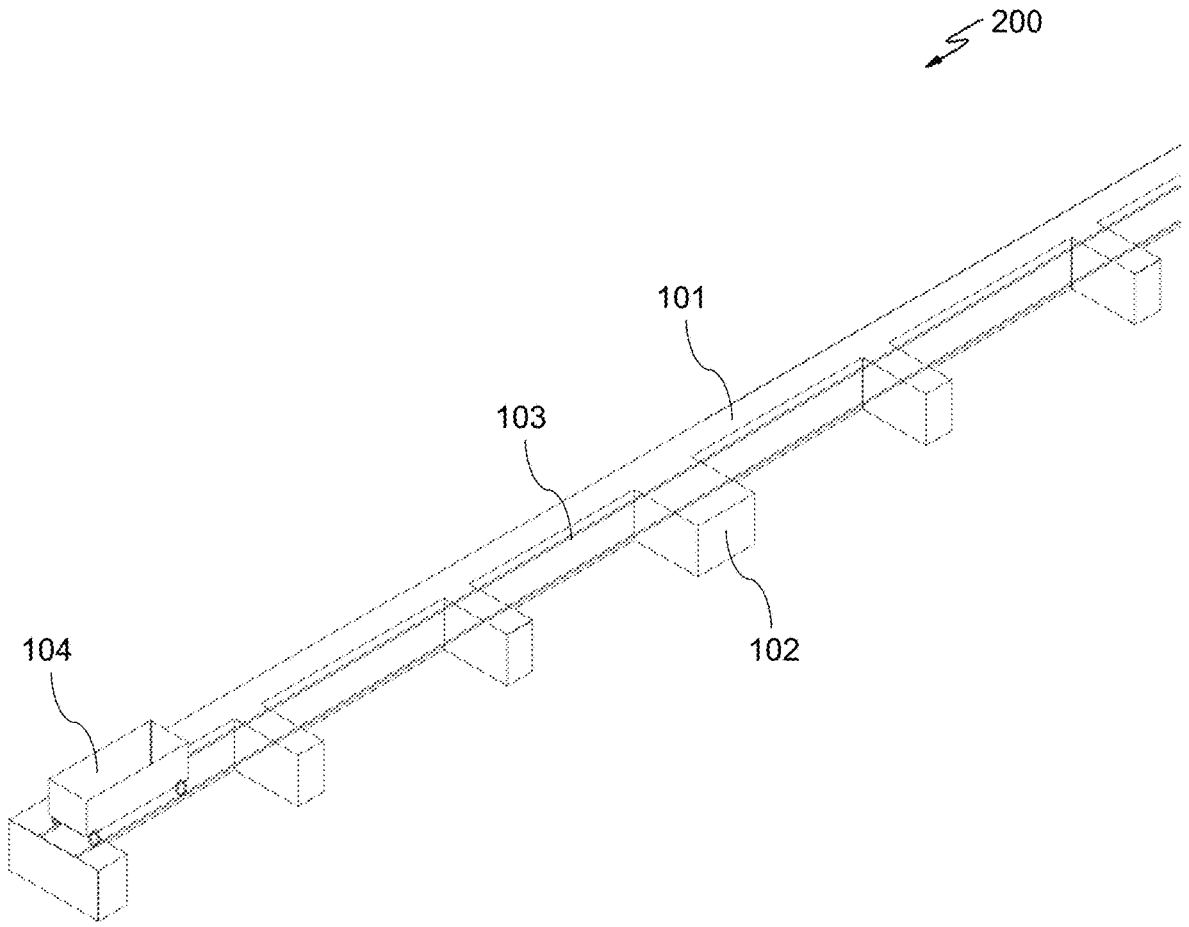
FIG. 2 is an isometric view of the rails laid over foundation for barrier wall, in accordance with one embodiment of the present invention.
Figure 3:
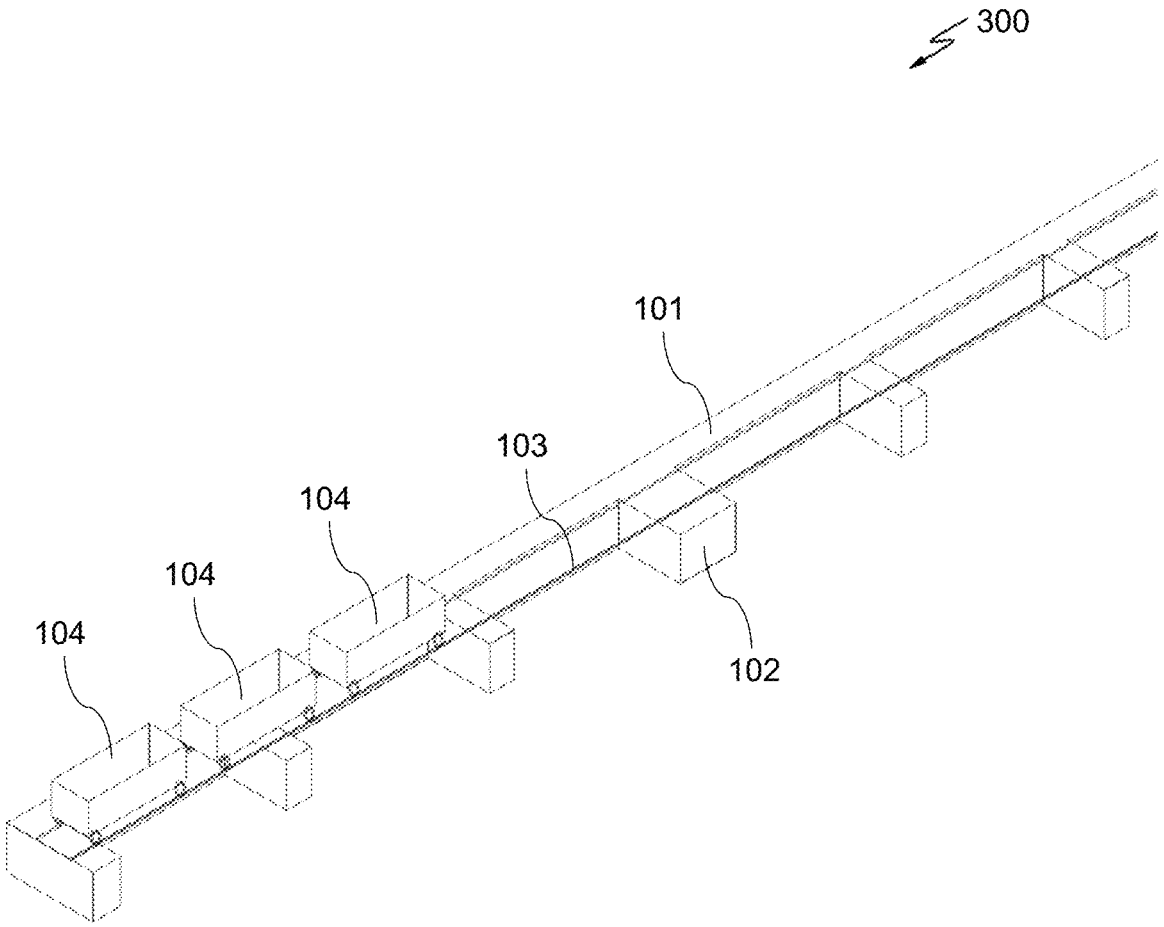
FIG. 3 is an isometric view of the wagons loaded over rails, in accordance with one embodiment of the present invention.
Figure 4:
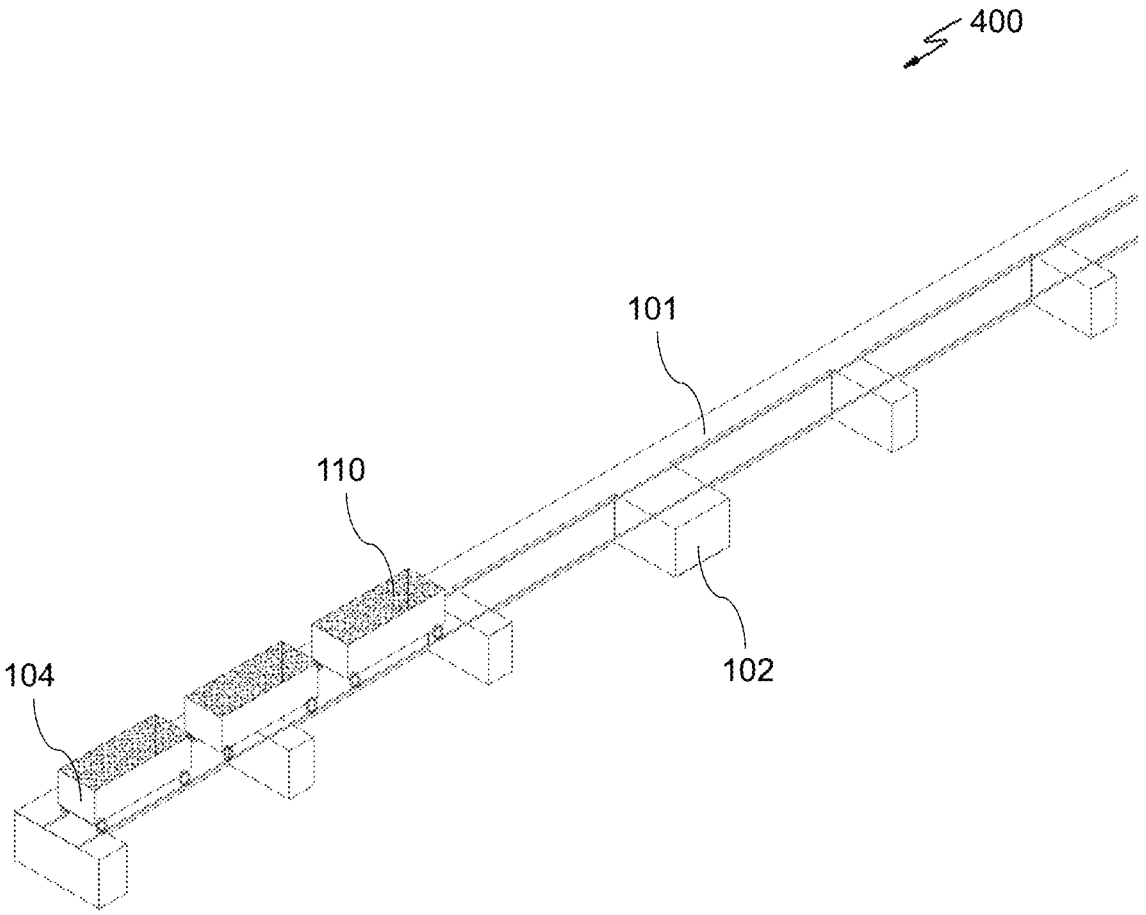
FIG. 4 is an isometric view of the wagons filled with construction material like concrete and other material, in accordance with one embodiment of the present invention.
Figure 5:
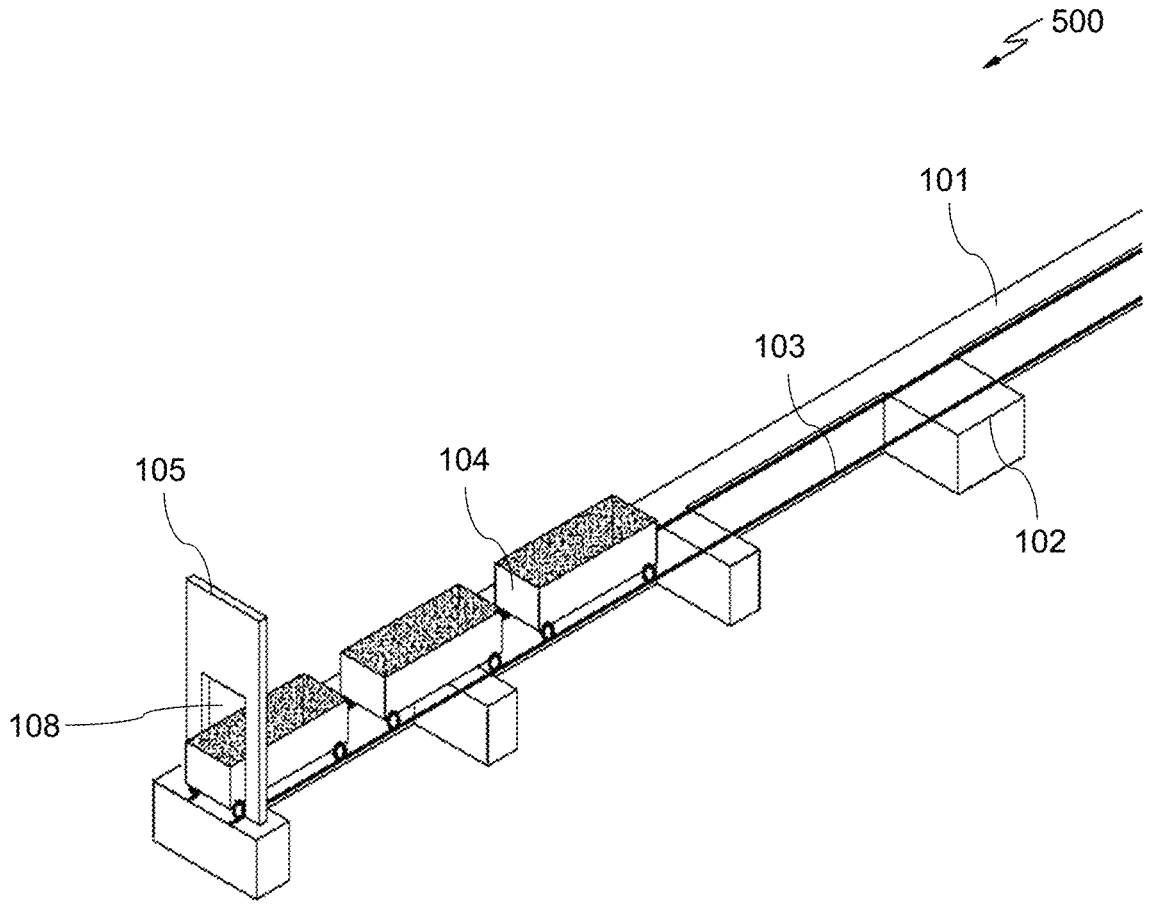
FIG. 5 is an isometric view of the construction of the lower first buttress wall piece, in accordance with one embodiment of the present invention.
Figure 6:
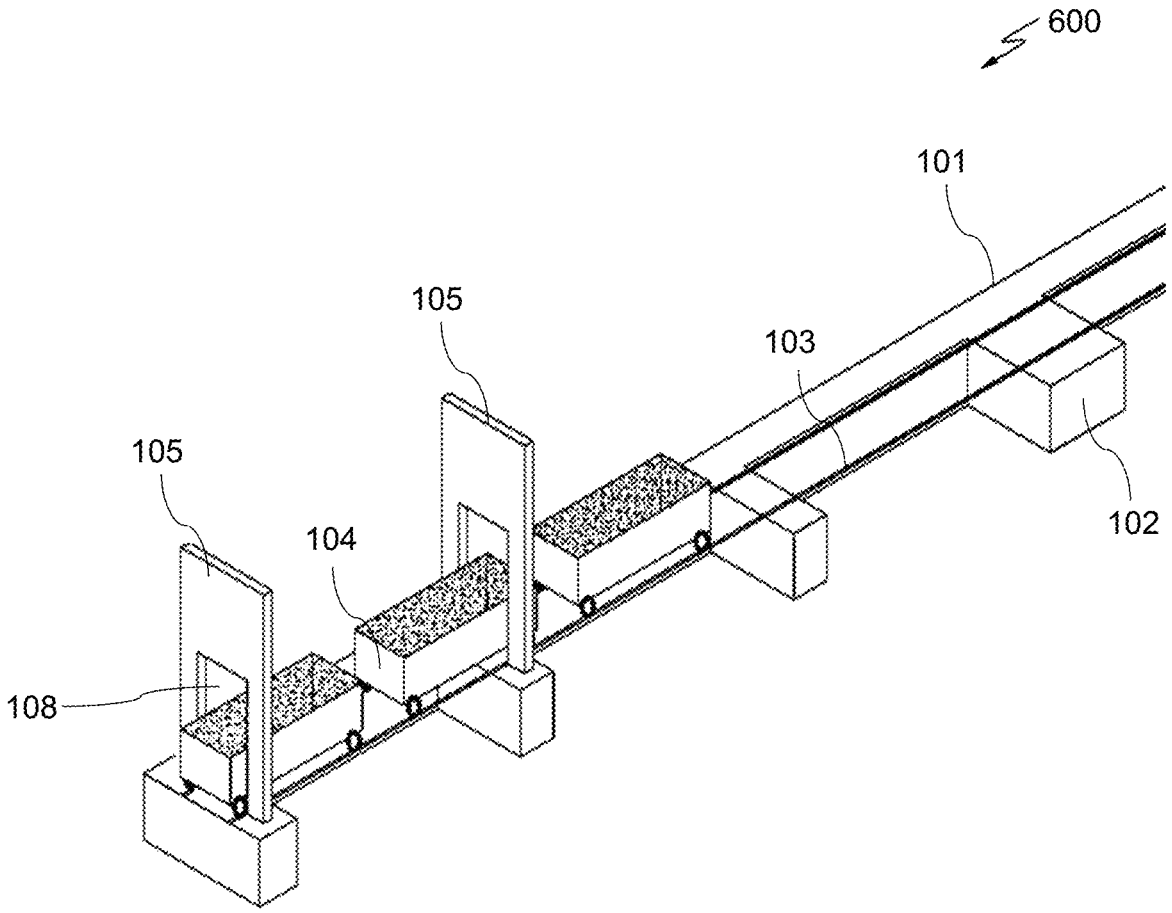
FIG. 6 is an isometric view of the construction of the lower second buttress wall piece, in accordance with one embodiment of the present invention.
Figure 7:
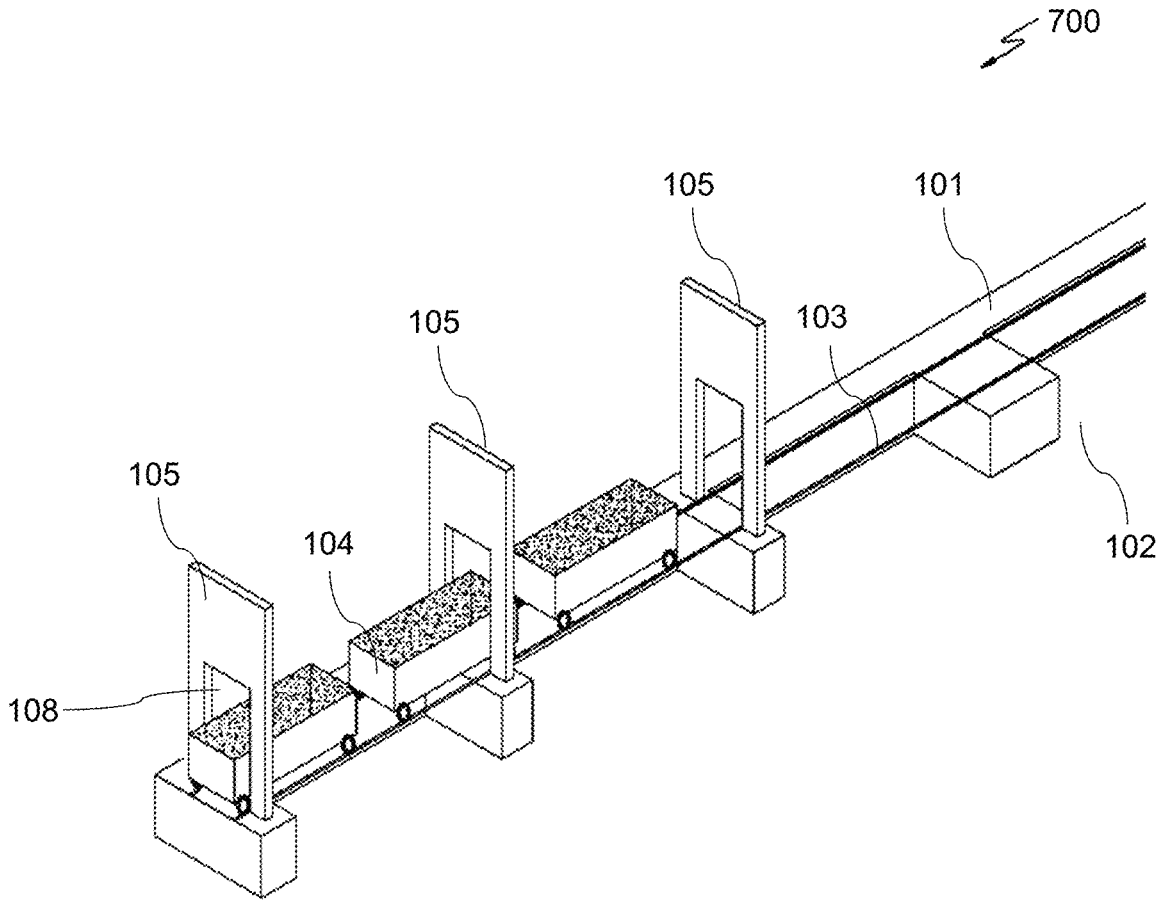
FIG. 7 is an isometric view of the construction of the lower third buttress wall piece, in accordance with one embodiment of the present invention.

The present invention provides for the method of construction a barrier wall and the barrier wall, wherein the barrier wall is designed for an optimized wall height, spacing between buttress and spacing between horizontal deck which results in minimum use of material, provide for a simplified and uniform construction process, and thus a reduction in cost for construction. By uniquely changing the approach from traditional 2-Dimensional design approach to a Multi-Dimensional design, the wall design results in reduction of materials required and also reduce the foundation design requirements in the Multi-Dimensional load transfer as compared to 2-Dimensional load transfer. Different structural elements are put to optimum use in multi-dimensional approach.

Present invention simplifies the construction process for barrier wall where the progressive construction of the barrier wall is done with the wagons travelling over the Rails. Rails are resting on the Foundation for the barrier wall construction and the Local dirt. Wagons contains the construction material concrete, cement, formwork etc. This Invention eliminate the need of the separate transport Road construction before the barrier wall construction Buttress walls are used to support the front wall and buttress walls provides the Multi-Dimensional approach for the load transfer. The critical load applied over the barrier wall is wind loaded on the surface from any direction. A multi-dimensional load transfer approach in the barrier wall reduces the thickness of wall, size of foundation and makes it economical as compared to the traditional wall designs.

By uniquely changing the approach from traditional construction approach to progressive construction approach, the barrier wall construction results in elimination of approach road required and also reduce the transportation cost for construction material like concrete, cement, formwork etc. The current invention is using progressive approach of construction hence it saves the infrastructure development cost for wall construction. By uniquely changing the approach from traditional security and monitoring approach to in built network of small circular pipes for security and monitoring features, it results in saving of materials required for building additional infrastructure and also reduce requirement of security features and monitoring features.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

FIGS. 1-16 depict multiple stages of the construction process of the barrier wall 200, in accordance with one embodiment of the present invention. In the depicted embodiment, a foundation 101 is formed over a predetermined distance based on the level and pitch of the ground. The foundation is formed from a single length of material with a set of protrusions formed to create a solid foundation 101. The protrusions 102 are spaced a set distance apart based on the buttresses and design of the wall. The foundation 101 is installed to have a relatively level top surface across the entire distance of the foundation 101. In certain embodiments, provided the incline of the foundation 101 is set known, the barrier wall 200 can be constructed to accommodate the incline, decline, or pitch of the barrier wall 200. The gaps between the protrusions 102 provide for reduced material needed, and with the foundation meeting the requirements of the depth and height of the wall, the protrusions 102 provide stability for the barrier wall 200.

In the depicted embodiment, a roadway or tracks 103 is constructed across the protrusions to allow for the transportation of materials, vehicles 104, workers, or the like. In some embodiments, the tracks 103 is a walkway. In the depicted embodiments, the vehicles 103 are used to carry supplies and materials 110 along the construction path of the barrier wall 200.

Figure 8:
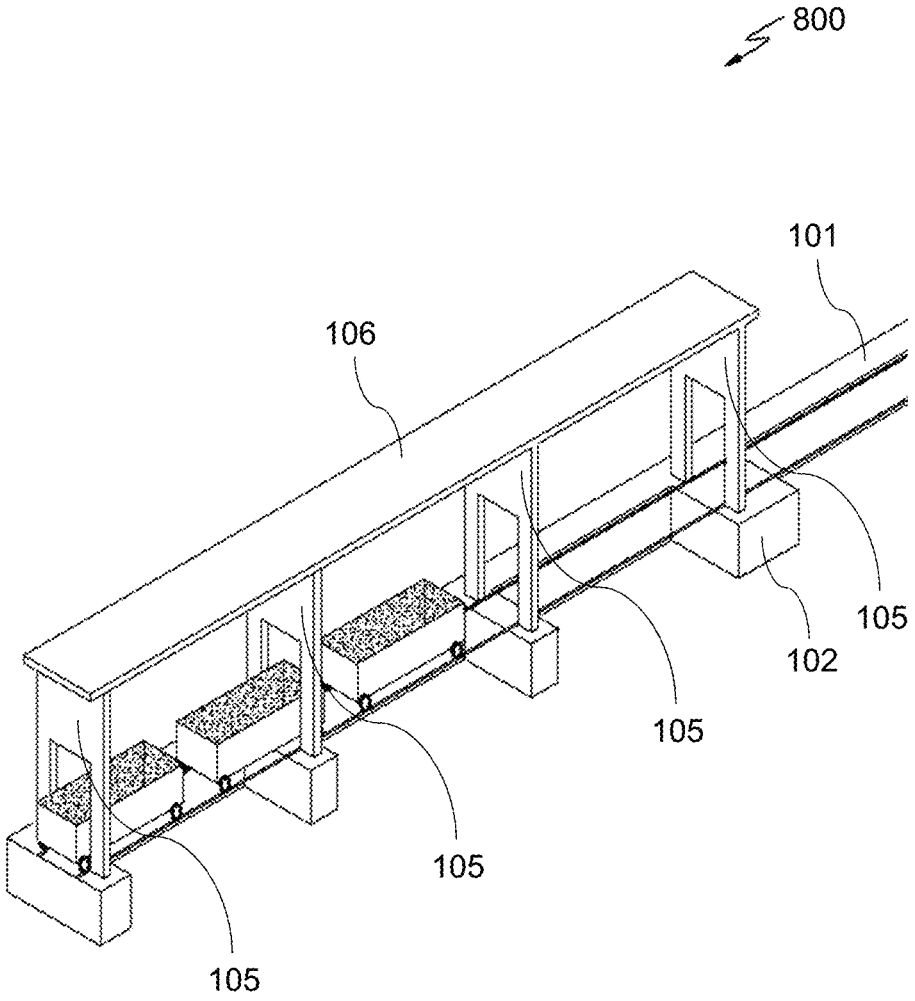
FIG. 8 is an isometric view of the construction of the lower fourth buttress wall piece, in accordance with one embodiment of the present invention.
Figure 9:
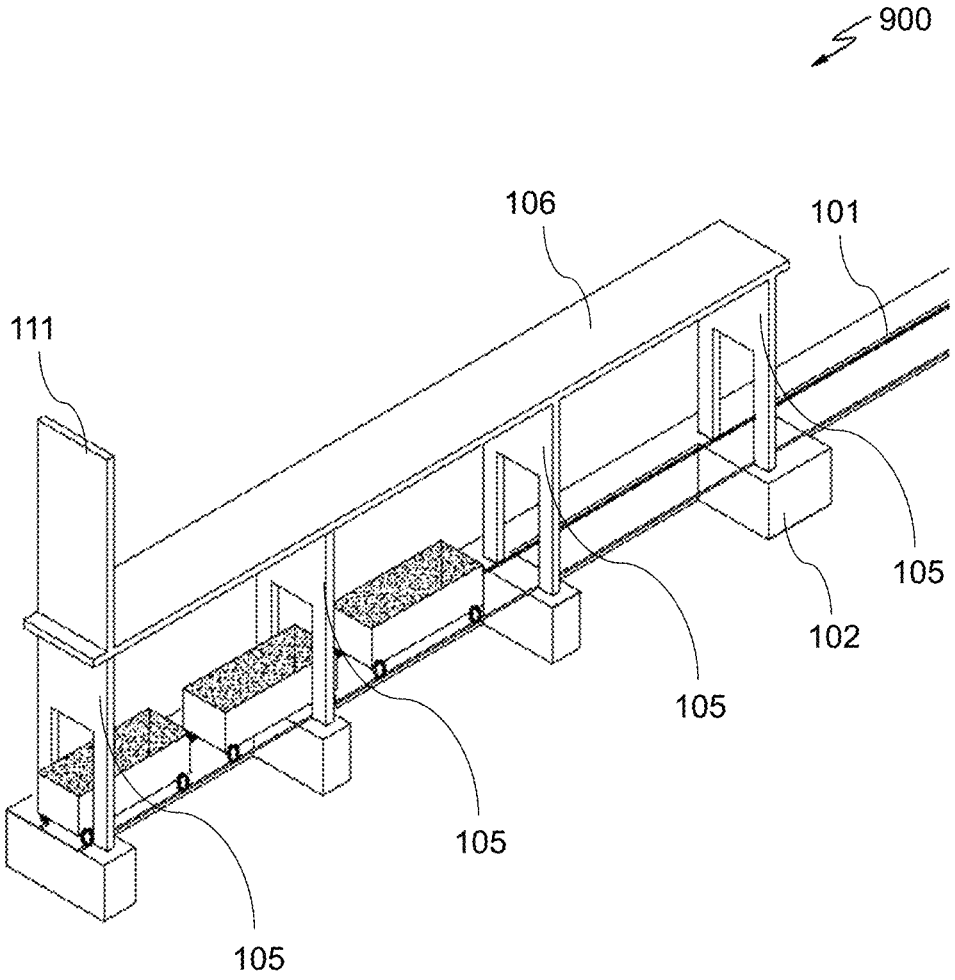
FIG. 9 is an isometric view of the lower deck construction, in accordance with one embodiment of the present invention.
Figure 10:
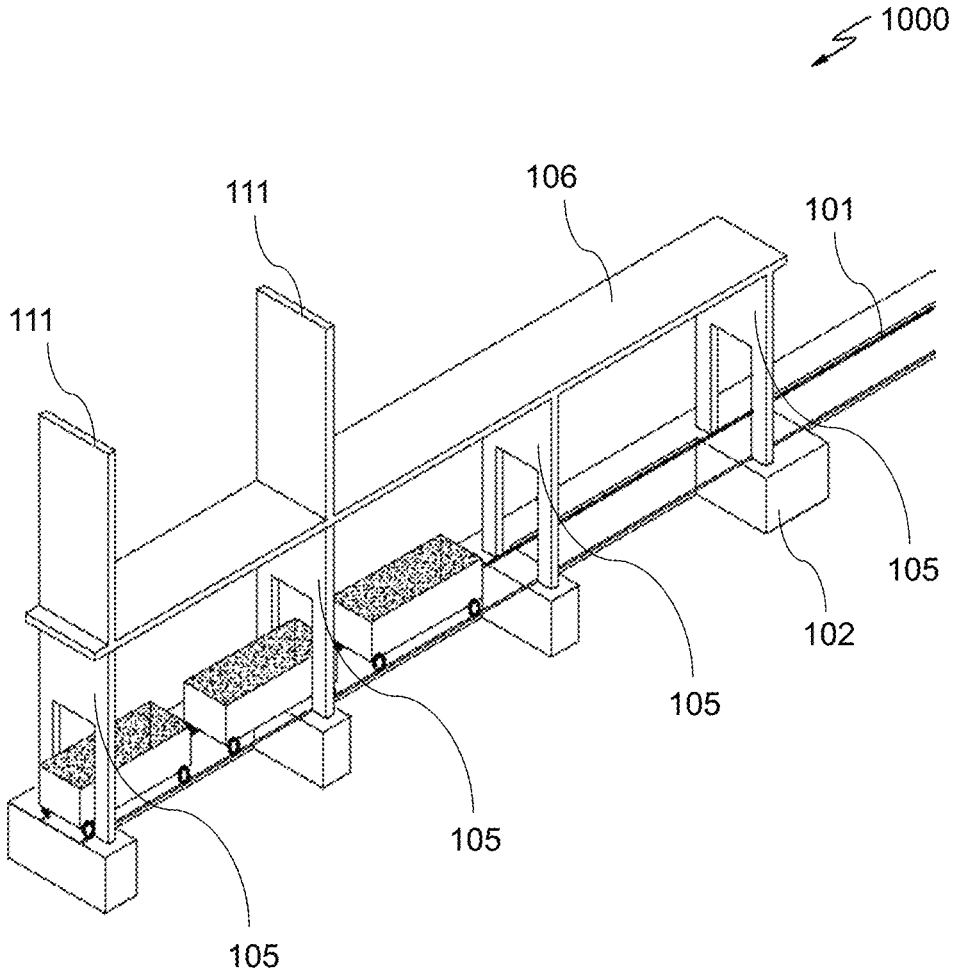
FIG. 10 is an isometric view of the construction of the upper first buttress wall piece, in accordance with one embodiment of the present invention.
Figure 11:
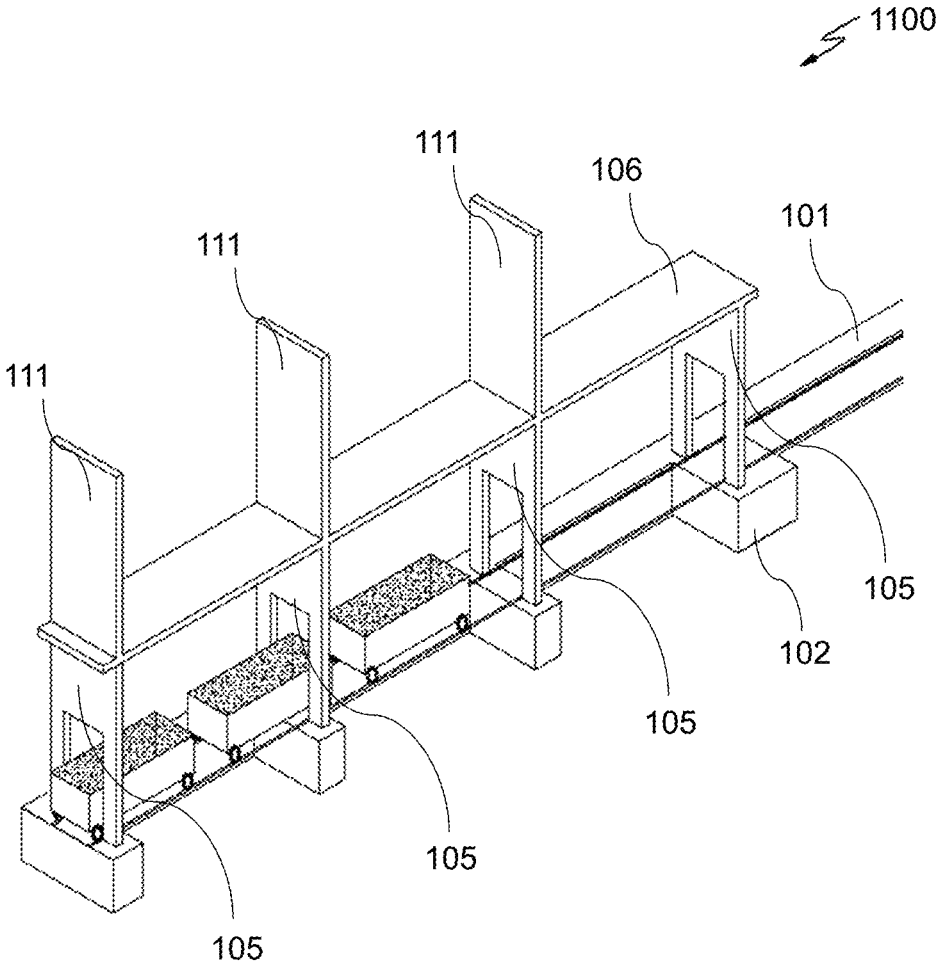
FIG. 11 is an isometric view of the construction of the upper second buttress wall piece, in accordance with one embodiment of the present invention.
Figure 12:
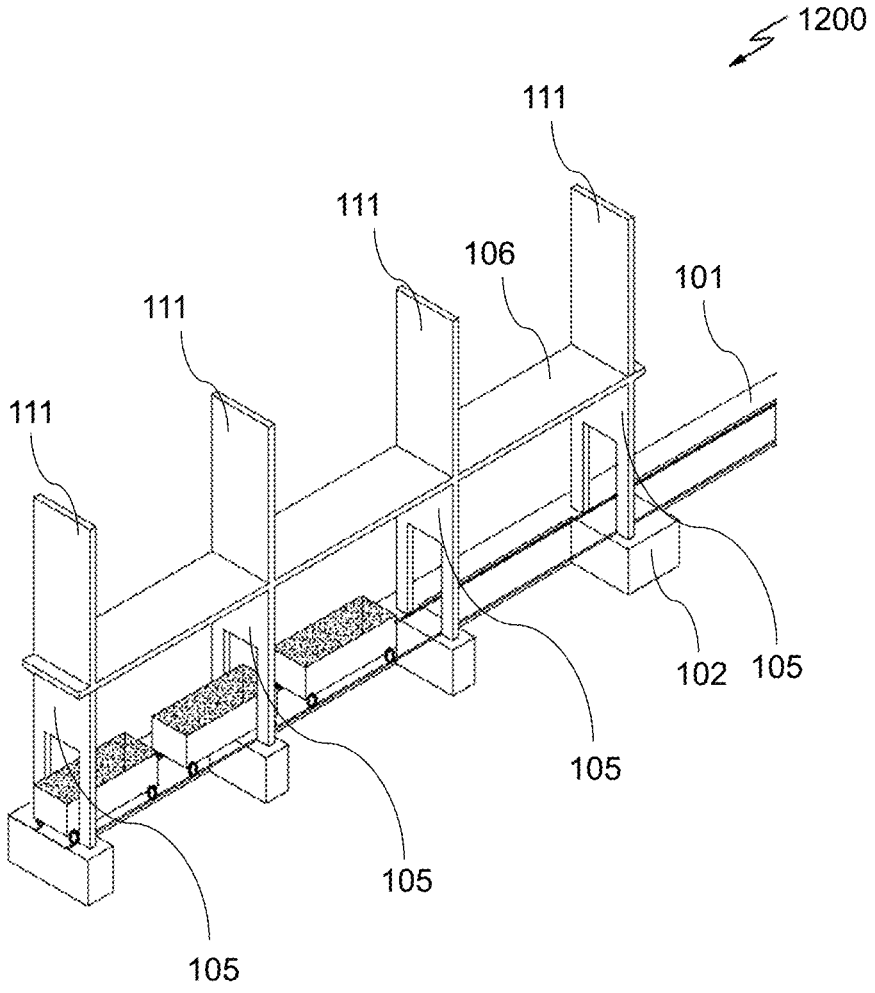
FIG. 12 is an isometric view of the construction of the upper third buttress wall piece, in accordance with one embodiment of the present invention.
Figure 13:
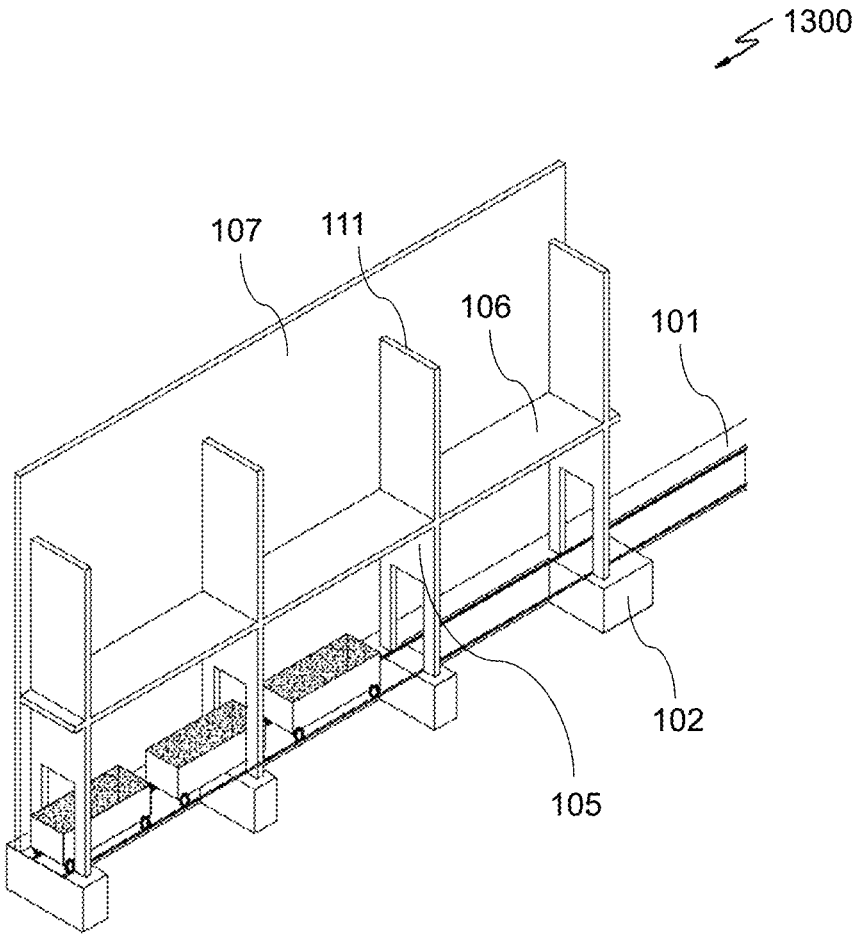
FIG. 13 is an isometric view of the construction of the upper fourth buttress wall piece, in accordance with one embodiment of the present invention.
Figure 14:
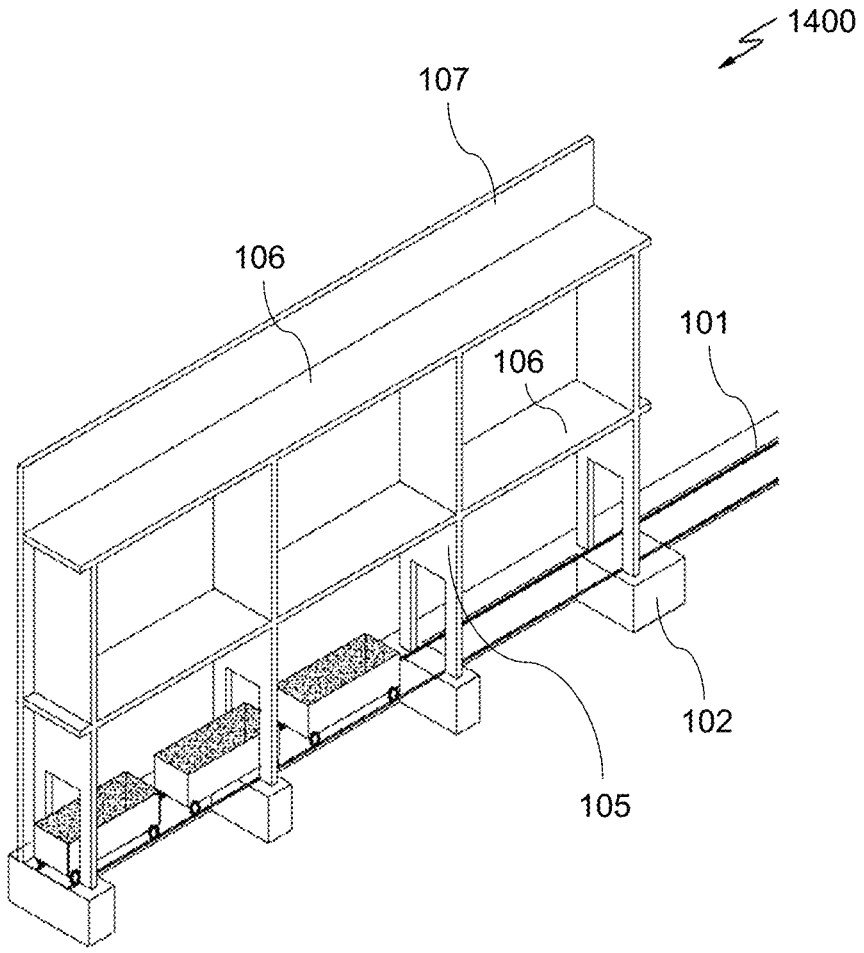
FIG. 14 is an isometric view of the front wall construction, in accordance with one embodiment of the present invention.
Figure 15:
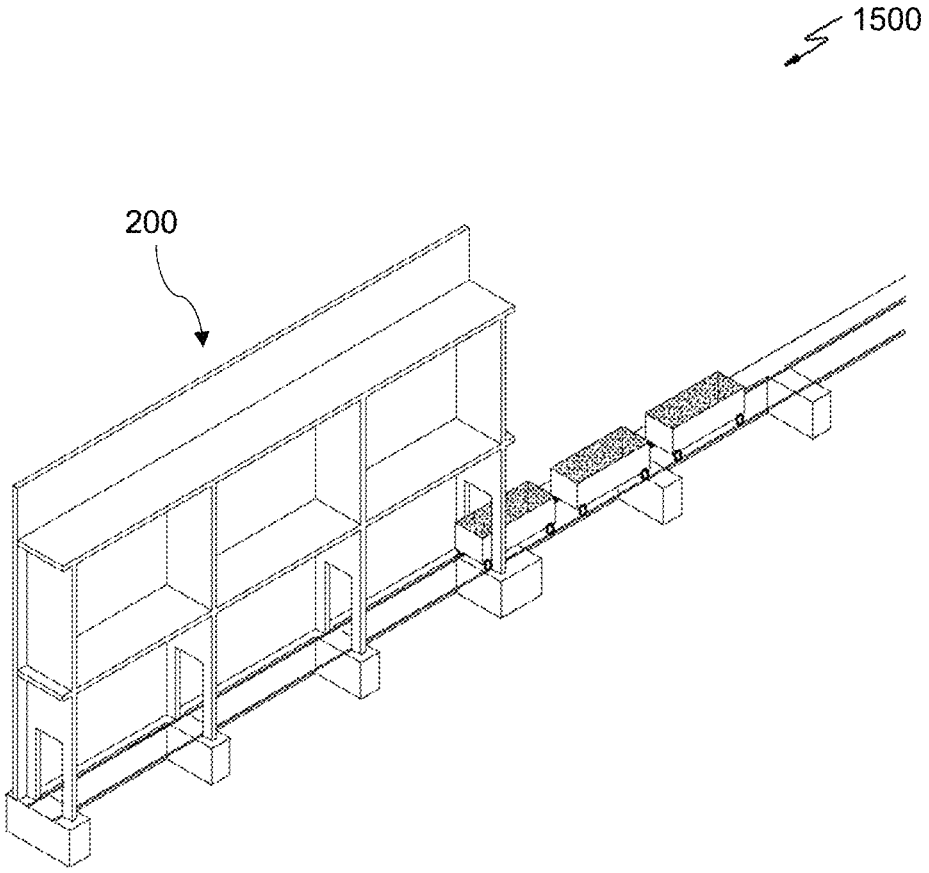
FIG. 15 is an isometric view of the upper deck construction, in accordance with one embodiment of the present invention.
Figure 16:
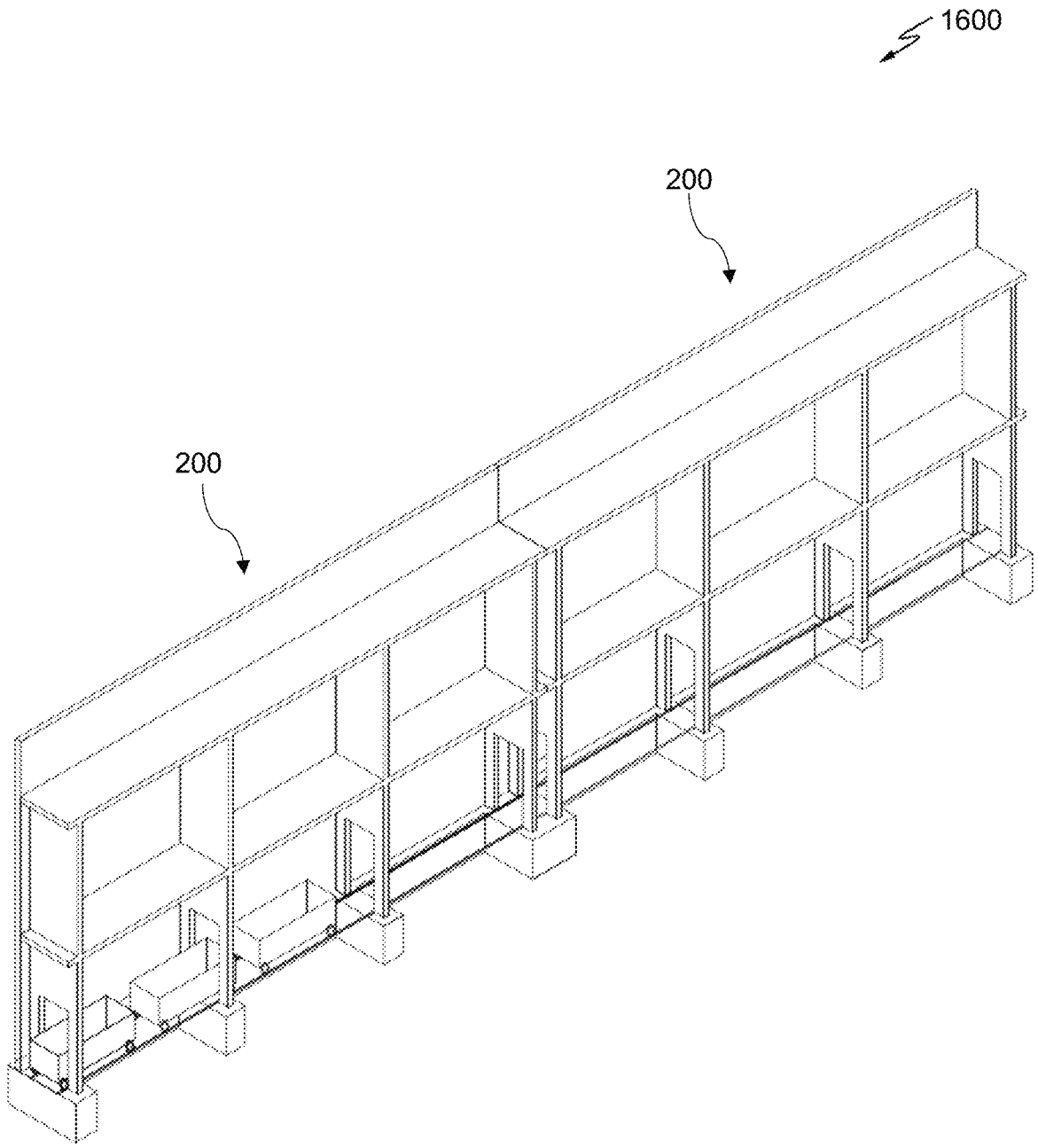
FIG. 16 is an isometric view of the movement of wagon over rail to next location, in accordance with one embodiment of the present invention.

The construction of the barrier wall 200 begins with the construction of the buttress walls 105 which are placed at each protrusion 102. The distancing of the protrusions 102 is based on the proper distancing of the buttress walls 105. In the depicted embodiment, the buttress walls 105 are constructed with apertures to permit the vehicles 103 to travel unimpeded along the tracks 103. These apertures or openings are designed to limit the reduction in the strength of the buttress walls 105. Upon the completion of the necessary number of buttress walls 105, the deck 106 is installed over the buttress walls 105. In FIG. 8, the deck 106 and the buttress wall 105 are a unitary component. In additional embodiments, the deck 106 and the buttress walls 105 may be preassembled as a single element or may be secured together through various methods known to one skilled in the art. Once the deck 106 is installed, another row of buttress walls 111 are installed in line with the previous set of buttress walls 105. Once the set of buttress walls 111 for the second row are installed another deck 106 is installed on top of those buttress walls 105, and the front wall 107 is then installed. With the installation of the front wall 107 the section of the barrier wall 200 is completed. Additional barrier wall 200*s* are created to create the entire barrier wall 200. Shown at the intersection of two barrier wall 200*s*, the protrusion 102 is sized to fit both buttress walls 105 for the two barrier wall 200 sections.

In the depicted embodiments, the front wall 107 is the same height as the buttress walls 105. During the construction process the buttress walls 107 are positioned a set distance from the front edge of the foundation 101 to account for the front wall 107 to be plated on the foundation. In some embodiments, the deck 106 height is from the foundation is half of the height of the front wall 107. In some embodiments, the deck height is a quarter of the front wall 107 height.

Figure 17:
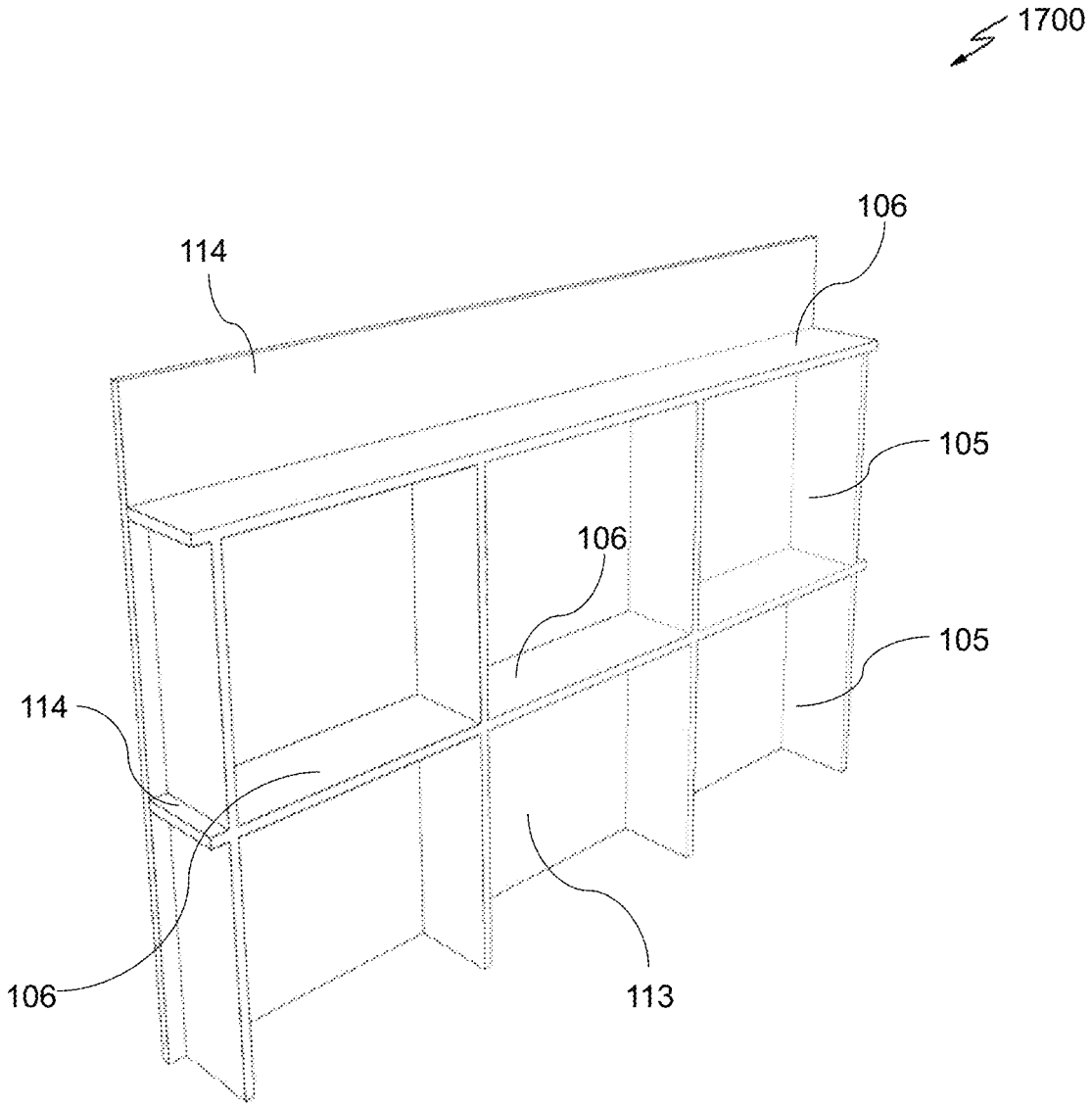
FIG. 17 is an isometric view of the construction of the adjacent module, in accordance with one embodiment of the present invention.
Figure 18:
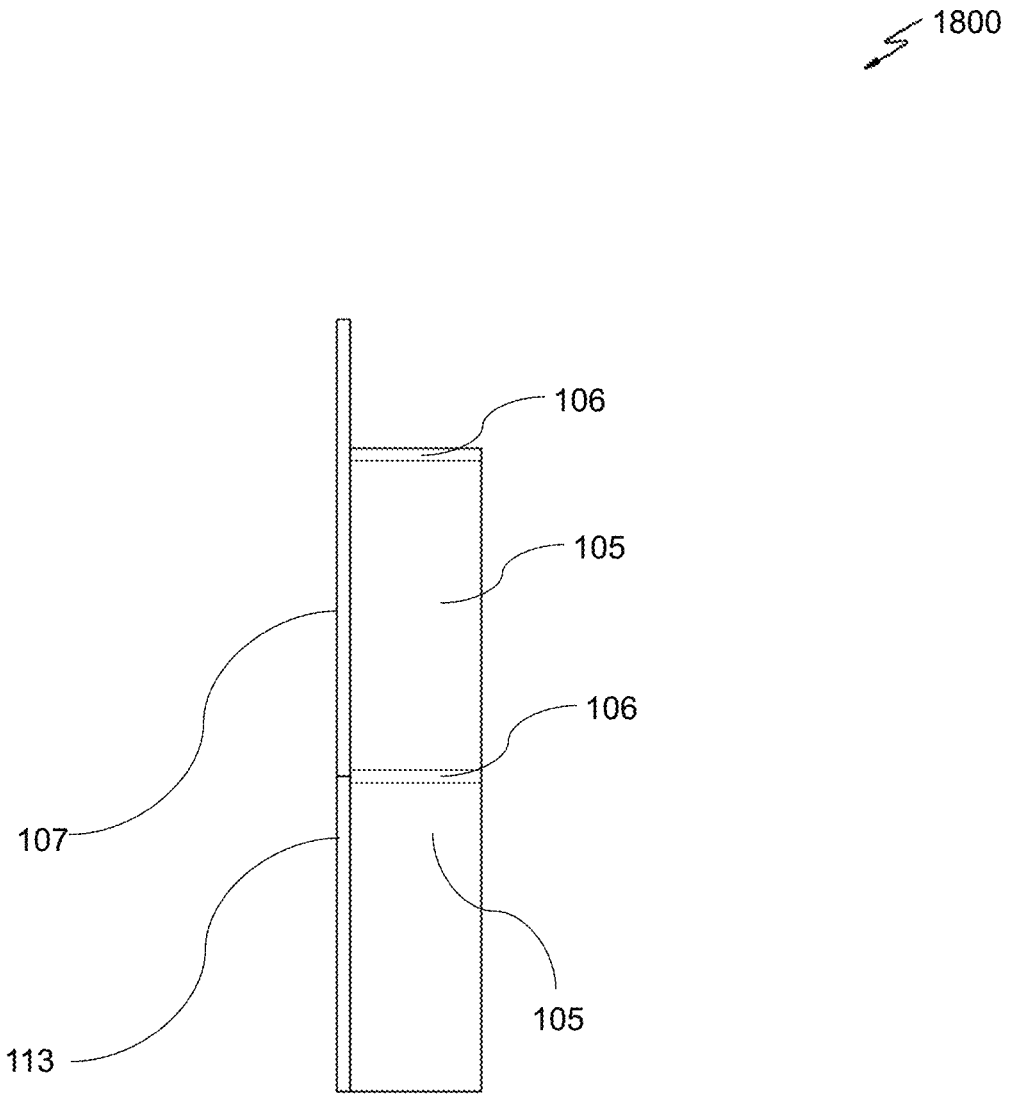
FIG. 18 is an isometric view of the barrier wall with buttress, in accordance with one embodiment of the present invention.
Figure 19:
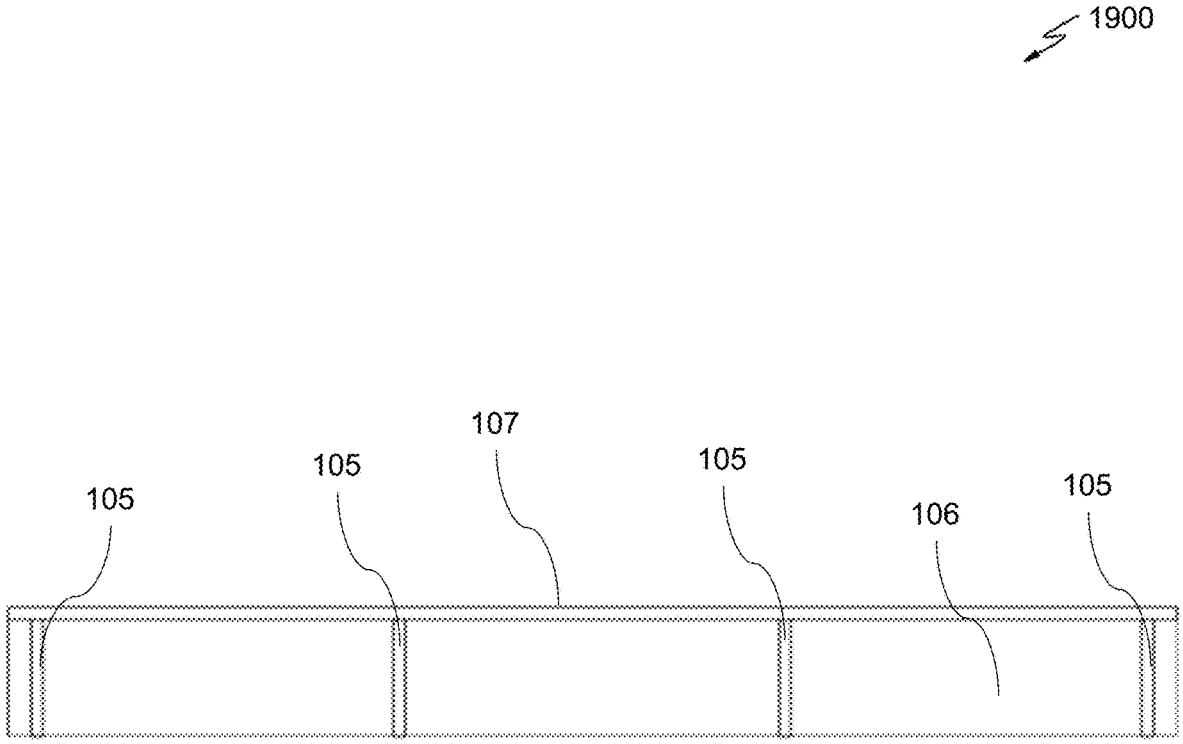
FIG. 19 is a section view of the barrier wall with buttress, in accordance with one embodiment of the present invention.

Depicted in FIGS. 17-19 are a barrier wall 200 wherein the front wall is separated into a lower section 113 and an upper section 114. Additionally, the buttress walls 105 are substantially the same from the lower level to the upper level. In the present embodiment, the track 103 is removed as the lower level buttress walls 105 do not have the aperture 108 present. In the present embodiment, extension 114 of the decks 106 provide a gap 114 between the barrier walls 200 when connected. In the depicted embodiment, several components of the barrier wall 200 are assembled as a unitary element. The elements of the barrier wall 200 may implement various reinforcement materials such as rebar and the like to further increase the strength of each element of the barrier wall 200 and the barrier wall as a whole.

The design of the present barrier wall 200 provides for the transfer of forces applied to the front of the front wall 107 to be transferred to the buttress walls 105. The bending moment of the front wall 107 is reduced due to the presence of the buttress walls 105 and thus the thickness of the front wall 107 can be decreased. In some embodiments, over the tradition barrier wall 200 designed, the front wall 107 may have a thickness which is a third or half.

Figure 20:
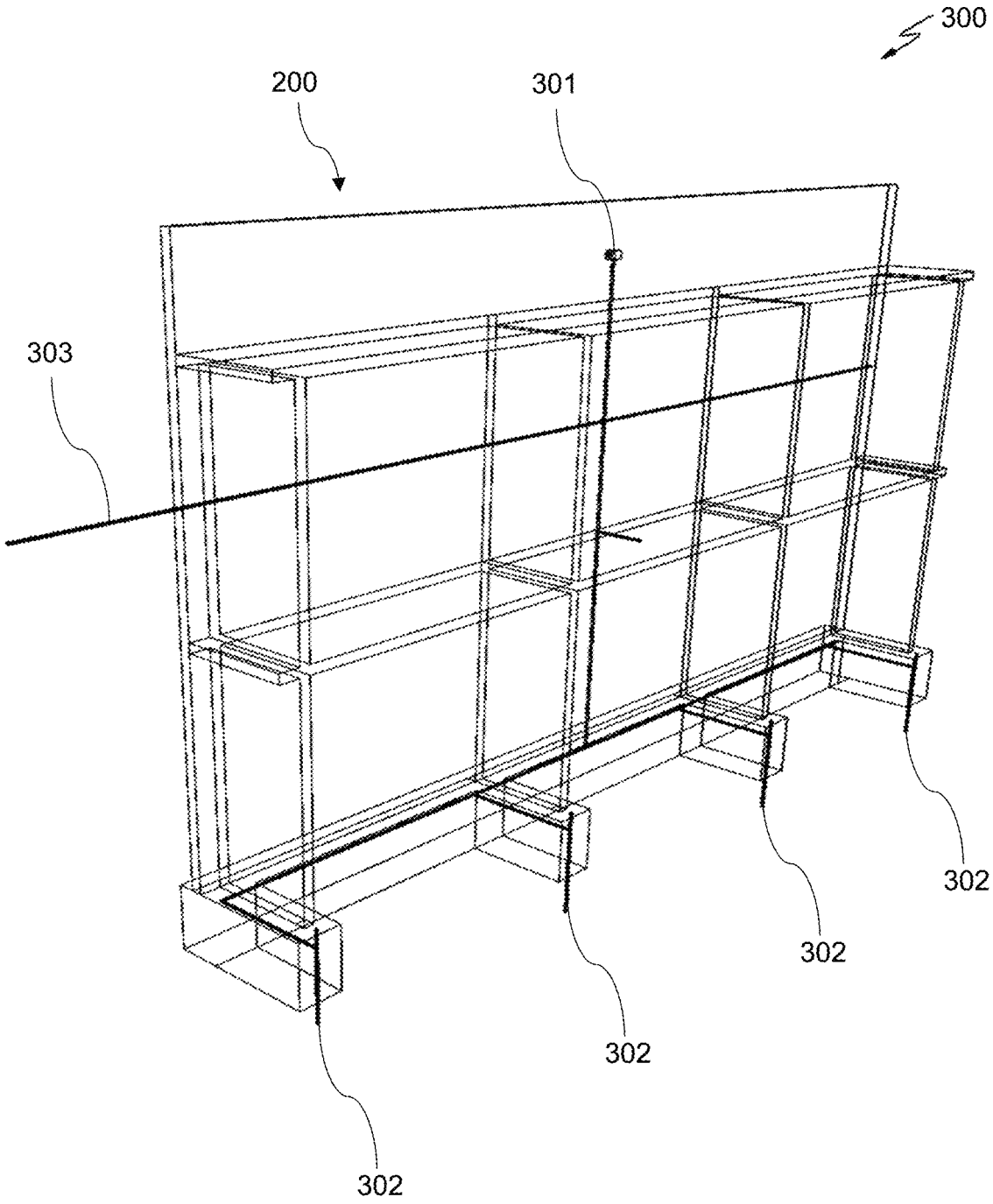
FIG. 20 is a plan view of the barrier wall with buttress, in accordance with one embodiment of the present invention.

Depicted in FIG. 20 is a barrier wall 200 with a plurality of security features integrated into the barrier wall 200. For example, a closed-circuit system 300 is integrated into the wall with cameras 301 positioned at various location along the barrier wall 200. In additional embodiments, lights may also be integrated into the system. In some embodiments, solar panels may be positioned on the various surfaces of the barrier wall 200 to provide power for the electrical system (s). Motion sensors 302 may be integrated into the system both above and below the ground. For the integration of these security and electrical systems, various conduits 303 and apertures are incorporated into the design of the buttress walls 105, the decks 106, and the front wall 107. Through the integration of the conduits within the solid structure there is less opportunity for the system to be tampered with. In some embodiments, the closed-circuit system 300 and the motion sensors 302 are in electronic communication with a computing device or central computing system. This computing system may be wired or wirelessly connected to the closed-circuit system 300.

The barrier wall 200 may be constructed from concrete with minimum reinforcement for thermal resistance.

A method of creating a barrier wall 200 depicted in FIGS. 1-16, in accordance with one embodiment of the present invention. The foundation is constructed for particular length, the length is typically between two points where the approach roads are already available. Rails and Wagons are placed over the foundation. From the approach point the construction material for the barrier wall 200 is loaded on the wagons and wagons travels progressively along the length of barrier wall 200 on the foundation. As the wagons progresses the construct each part of the barrier wall 200 starting with the lower buttress walls 105, the first deck 106, the upper buttress walls 105, and the second deck 106 and then the front wall 107 is installed. The front wall 107 rests unattached, at each end respectively upon one of the two columns. In assembling the barrier wall 200, earth is piled behind the front of a foundation and over the buttress wall base 105 and against the front wall 107, to a level that is slightly below the top of the protrusion 102.

In some embodiments, the buttress walls 105, the deck 106, and a front wall portion 107 are a modular assembly, which can be stacked to create a barrier wall 200 of various heights. The lower edge of the modular assembly has a design to integrate into the top edge of the foundation 101 or a tope edge of a modular assembly. In some embodiments, this is shiplap type edge design. In other embodiments, the lower edge of the modular assembly terminates at the buttress wall 105 which it is joined with. A downward facing gap therefore is defined by edge surfaces of the buttress wall 105. When the second modular assembly is stacked over the first modular assembly, installed on the earth fill behind the first modular assembly, the gap allows the top edge of the first modular assembly to extend up in to the gap without binding so that the vertically disposed tiers formed by the stacked modules can move independently.

The advantage of the stacked modular assemblies provides for increase relative movement between vertical tiers and assists with reducing bearing stress on the soil below the foundation 101 by creating arches in the soil. This reduces necessary length of the protrusions 102 and the buttress walls 105.

In one embodiment the barrier wall 200 has embedded pipes to form the network of a main pipe and secondary pipes. The monitoring feature is embedded inside the wall members. The wire for a close circuit camera passes from the secondary pipes and connect to main pipe. Monitoring feature of motion sensor probe is provided inside the base of Buttress wall 105 and the protrusions 102. Wire for the motion sensor probe is passes through the secondary pipe to connect to main pipe. A monitoring system can be connected to the security systems and has access via the main pipe. The main pipe passes from one modular assembly to the next.

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein that are believed as maybe being new, this understanding, as indicated by use of the term "present invention," is tentative and provisional and subject to change over the course of patent prosecution as relevant information is developed and as the claims are potentially amended.

The foregoing descriptions of various embodiments have been presented only for purposes of illustration and description. They are not intended to be exhaustive or to limit the present invention to the forms disclosed. Accordingly, many modifications and variations of the present invention are possible in light of the above teachings will be apparent to practitioners skilled in the art. Additionally, the above disclosure is not intended to limit the present invention. In the specification and claims the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered, joined) are to be construed broadly and may include intermediate members between a connection of elements and relative movement between elements. As such, joinder references do not necessarily infer that two elements are directly connected and in fixed relation to each other. Moreover, network connection references are to be construed broadly and may include intermediate members or devices between network connections of elements. As such, network connection references do not necessarily infer that two elements are in direct communication with each other. In some instances, in methodologies directly or indirectly set forth herein, various steps and operations are described in one possible order of operation, but those skilled in the art will recognize that steps and operations may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements and/or substantial equivalents.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A barrier wall comprising:

a foundation, wherein the foundation has a plurality of extensions protruding from one side of the foundation;

a set of lower buttress walls positioned along each of the extensions;

a first deck positioned on the first set of lower buttress walls, wherein the set of lower buttress walls have an aperture along a lower edge;

a set of rails extending through the apertures of the set of lower buttresses;

a set of upper buttress walls positioned along the decks upper surface;

a second deck positions on the second set of upper buttress walls; and a front wall positioned to substantially cover the set of lower buttress walls, the lower deck, the set of upper buttress walls, and the upper deck.

2. The barrier wall of claim 1, wherein the set of upper buttress walls are substantially aligned with the set of lower buttress walls.

3. The barrier wall of claim 1, further comprising a vehicle movable along the set of rails.

4. The barrier wall of claim 1, further comprising a closed-circuit security system integrated into the barrier wall.

5. The barrier wall of claim 4, further comprising a subterranean motion sensing probe system integrated into the closed circuit security system.

6. The barrier wall of claim 1, wherein the set of lower buttress walls and the set of upper buttress walls extend a predetermined distance from a first end of the corresponding deck.

7. A method of construction a barrier wall comprising:

creating a foundation, wherein the foundation consists of a first section and a set of extensions protruding from an edge of the first section;

installing a set of tracks extending over the set of extensions;

securing a set of lower buttress walls on the set of extensions, wherein the set of lower buttress walls have an aperture wherein the aperture is positioned over the tracks;

setting a deck on the set of lower buttresses;

installing a set of upper buttress walls on a top surface of the deck, wherein the set of lower buttress walls and the set of upper buttress walls are substantially aligned with one another;

installing a deck on the upper set of buttress walls; and securing a front wall to the buttress walls and decks, wherein the front wall is positioned along the first section of the foundation.

8. The method of construction a barrier wall of claim 7, further comprising a series of recording devices integrated into the barrier wall.

9. The method of construction a barrier wall of claim 7, further comprising integrating a series of motion sensing probes below the foundation.

10. The method of construction a barrier wall of claim 7, wherein the front wall is comprised of a series of sections.

11. The method of construction a barrier wall of claim 7, wherein the upper buttress walls and the lower buttress walls are offset a predetermined distance.

12. The method of construction a barrier wall of claim 7, wherein the front wall extends a predetermined distance above the deck.

13. The method of construction a barrier wall of claim 7, further comprising a integrated system of conduits within the barrier wall for the recording devices and motion sensing probes to be in electronic communication with a computing device.

* * * * *